US005961257A

United States Patent [19]

Bettini et al.

[11] Patent Number: 5,961,257

[45] Date of Patent: Oct. 5, 1999

[54] DRILL FOR DRILLING CROSSTIES, PARTICULARLY FOR USE IN THE RAILROAD SECTOR

[75] Inventors: Marco Bettini, Botticino; Ezio Degiacomi, Caino, both of Italy

[73] Assignee: Cembre S.p.A., Brescia, Italy

[21] Appl. No.: 09/019,708

[22] Filed: Feb. 6, 1998

[30] Foreign Application Priority Data

Mar. 3, 1997 [IT] Italy ..... MI97A0465

[51] Int. Cl.[6] ..... B23B 45/14

[52] U.S. Cl. ..... 408/97; 408/81; 408/112; 408/710; 279/82

[58] Field of Search ..... 408/80, 81, 97, 408/110, 112, 82, 214, 241 G, 710; 279/82, 904

[56] References Cited

U.S. PATENT DOCUMENTS

| | | | |
|---|---|---|---|
| 248,854 | 11/1881 | Gladwin | 408/214 |
| 1,316,027 | 9/1919 | Halbreich | 408/112 |
| 1,470,143 | 10/1923 | Buterbaugh | 408/112 |
| 1,856,973 | 5/1932 | Smith | 279/74 |
| 2,335,614 | 11/1943 | Spievak | 408/81 |
| 4,552,494 | 11/1985 | Wix | 408/241 G |

FOREIGN PATENT DOCUMENTS

| | | |
|---|---|---|
| 636 967 | 4/1928 | France . |
| 989 805 | 9/1951 | France . |
| 179 348 | 12/1906 | Germany . |
| 247 497 | 5/1912 | Germany . |
| 94 21 245 | 8/1995 | Germany . |

*Primary Examiner*—Steven C. Bishop
*Attorney, Agent, or Firm*—Guido Modiano; Albert Josif

[57] ABSTRACT

A drill for drilling crossties, particularly for use in the railroad sector, comprising a protective enclosure which is formed by a movable portion and by a fixed portion and is suitable to completely cover a chuck of the drill and a drilling bit coupled to the chuck; sliding means which allow the sliding of the movable portion with respect to the fixed portion when the movable portion is placed at an area to be drilled and at the beginning of the drilling operation; and resilient means adapted to bias the sliding of the movable portion with respect to the fixed portion and suitable to be loaded by the penetration of the drilling bit and, at the end of the drilling operation, to be released for the quick disengagement of the bit from a hole formed during the drilling operation.

20 Claims, 4 Drawing Sheets

DRILL FOR DRILLING CROSSTIES, PARTICULARLY FOR USE IN THE RAILROAD SECTOR

BACKGROUND OF THE INVENTION

The present invention relates to a drill for drilling crossties, particularly adapted for use in the railroad sector.

It is known that rolling stock runs on two steel rails which are kept, by various means, at a constant distance known as gauge. The rails can be supported by crossties, longitudinal ties, isolated supports and special systems, but the commonest support system is based on crossties.

Crossties are generally made of wood, since they are capable of giving the track the necessary elasticity, which is a requirement whose importance increases with the speed of the service to be performed.

The rails are usually connected to the crossties indirectly, by first connecting, with anchoring screws, the rail to a plate and then connecting, by means of spikes, the plate to the corresponding crosstie.

In order to form the holes for the passage of the fixing spikes in the ties, it is necessary to use special drilling machines which are preset for this specific function, working along the tracks of a railroad line.

These machines generally have a considerable weight and size and therefore often entail difficulties in use.

In particular, machines are commonly known which, owing to their size, have a truck of their own for traveling on the rails; machines are also known which require suitable supports to be started and/or placed in depot.

It is therefore evident that these drilling machines cannot be easily moved by a user, let alone be carried by hand.

These conventional drilling machines commonly use helical bits which have a front self-tapping element, through which the bit is forced to penetrate the material (wood) quickly but usually in a scarcely controllable manner.

A possible consequence of this is the drawback of jamming the helical bit during an intermediate step of drilling.

Moreover, since drilling operations can occur on active sections, i.e., sections affected by railroad traffic, if the bit jams in the crosstie during an intermediate step of drilling with conventional drilling machines, it would not be possible to quickly evacuate the work area should a train be about to transit.

This is due to the fact that the operation for extracting the bit from the hole formed in the crosstie is troublesome and not straightforward.

Moreover, also extracting the bit from the chuck of the drill entails difficulties and this entails a risk for the user who wishes to evacuate the work area as quickly as possible: the difficulty in extracting the drill bit in case of emergency (sudden arrival of a train) might entail the need to abandon the drill, with the risk of destroying it and of possibly damaging the train.

Another drawback of conventional drilling machines is the fact that the helical bit, driven by a specifically provided chuck, can accidentally make contact with a part of the body of the operator, with consequent danger of work accidents.

SUMMARY OF THE INVENTION

The aim of the present invention is to provide a drill for drilling ties, particularly for use in the railroad sector, having means adapted to avoid the risk of work accidents, with particular regard to physical injury caused by contact with the rotating bit of the drill.

Within the scope of this aim, an object of the present invention is to provide a drill for drilling ties, particularly for use in the railroad sector, having a drilling control system with correct centering of the bit at the specifically provided existing holes on the plate for resting the rails on the wood crossties.

Another object of the present invention is to provide a drill for drilling crossties, particularly for use in the railroad sector, which allows easier extraction of the bit from the crosstie once the drilling operation has been completed.

Another object of the present invention is to provide a drill for drilling crossties, particularly for use in the railroad sector, which can use currently commercially available bits.

Another object of the present invention is to provide a drill for drilling crossties, particularly for use in the railroad sector, which has a modest weight and size and in particular is portable without having to resort to supports or trucks and the like.

Another object of the present invention is to provide a drill for drilling crossties which is highly reliable, relatively easy to manufacture and at low costs.

This aim, these objects and others which will become apparent hereinafter are achieved by a drill for drilling crossties, particularly for use in the railroad sector, characterized in that it comprises: a protective enclosure formed by a movable portion and by a fixed portion suitable to completely cover a chuck of a drill and a drilling bit coupled to said chuck; sliding means which allow the sliding of said movable portion with respect to said fixed portion when said movable portion is placed at an area to be drilled and at the beginning of the drilling operation; and resilient means adapted to bias the sliding of said movable portion with respect to said fixed portion, said resilient means being suitable to be loaded by the penetration of said drilling bit and, at the end of said drilling operation, to be released for the quick disengagement of the bit from a hole formed during the drilling operation.

BRIEF DESCRIPTION OF THE DRAWINGS

Further characteristics and advantages of the present invention will become apparent hereinafter from the following detailed description of a preferred but not exclusive embodiment of the drill according to the invention, illustrated only by way of non-limitative example in the accompanying drawings, wherein.

DESCRIPTION OF THE PREFERRED EMBODIMENTS

Figure 1:
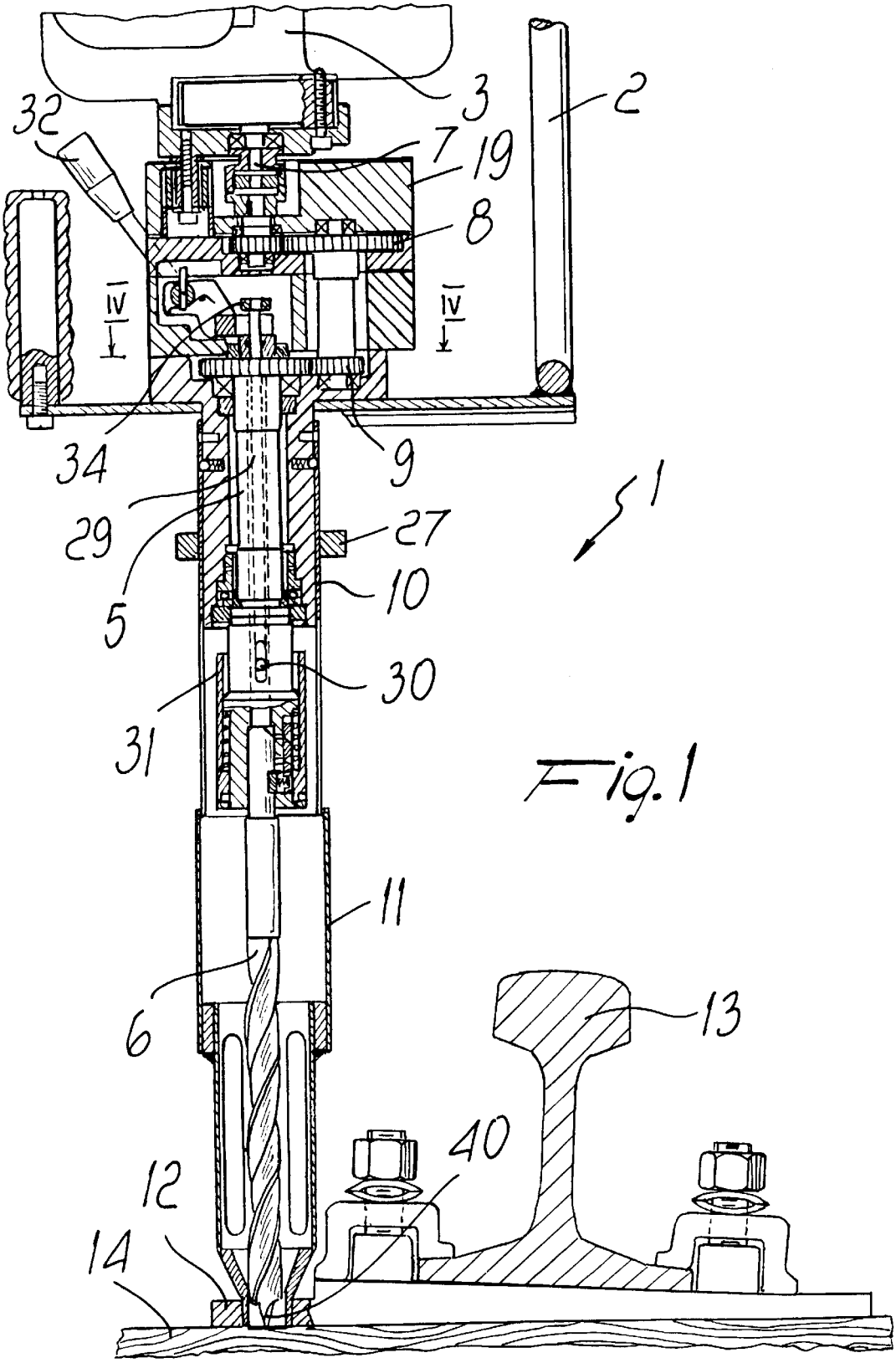
FIG. 1 is a partially sectional lateral elevation view of the drill according to the present invention, with the bit in the position for drilling a crosstie.
Figure 2:
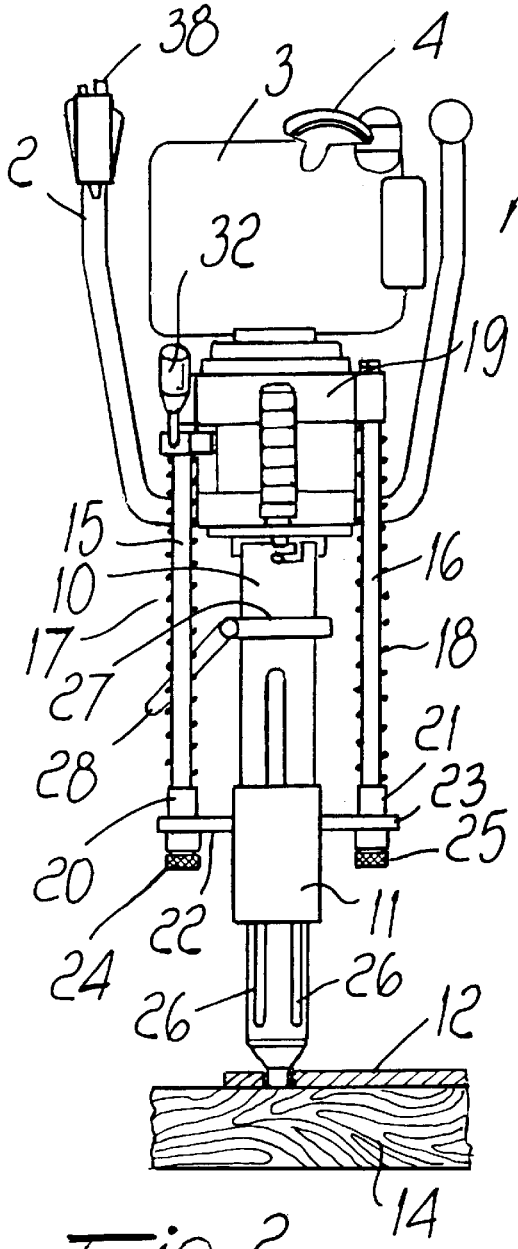
FIG. 2 is a front elevation view of the drill according to the present invention, with the bit in the initial position before drilling.
Figure 3:
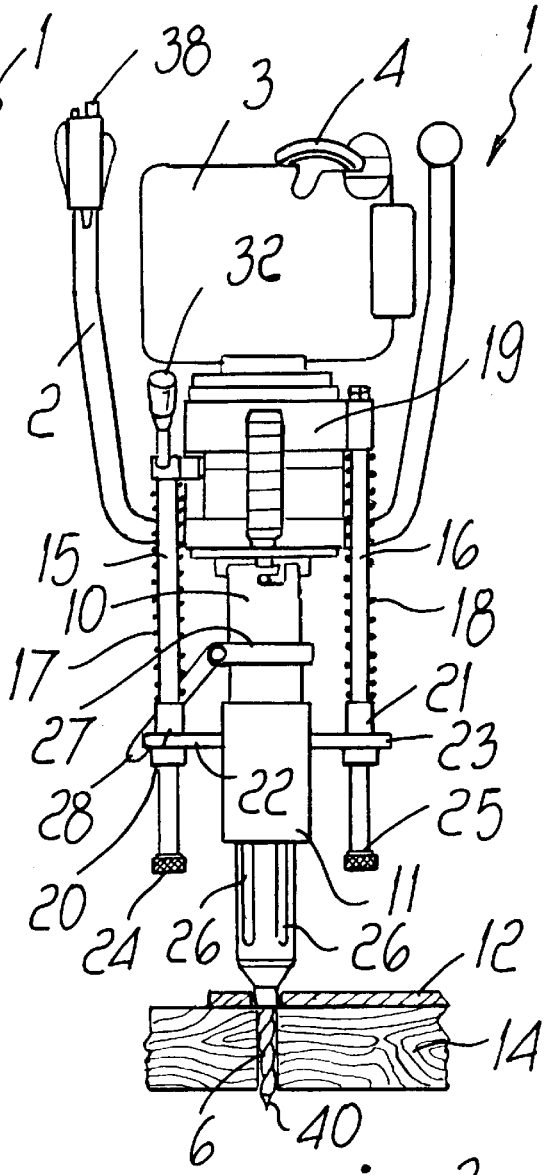
FIG. 3 is a front elevation view of the drill according to the present invention, with the bit in the final position, at the end of the drilling operation.
Figure 4:
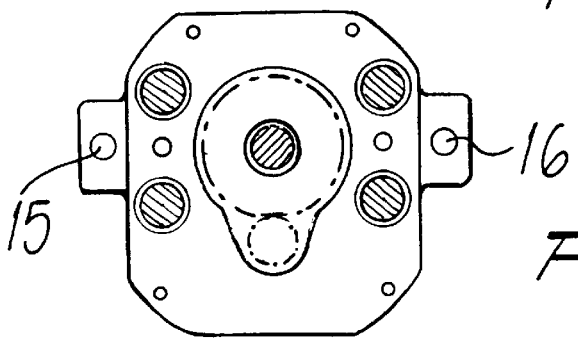
FIG. 4 is a sectional view, taken along the plane IV—IV, of the drill shown in FIG. 1.
Figure 5:
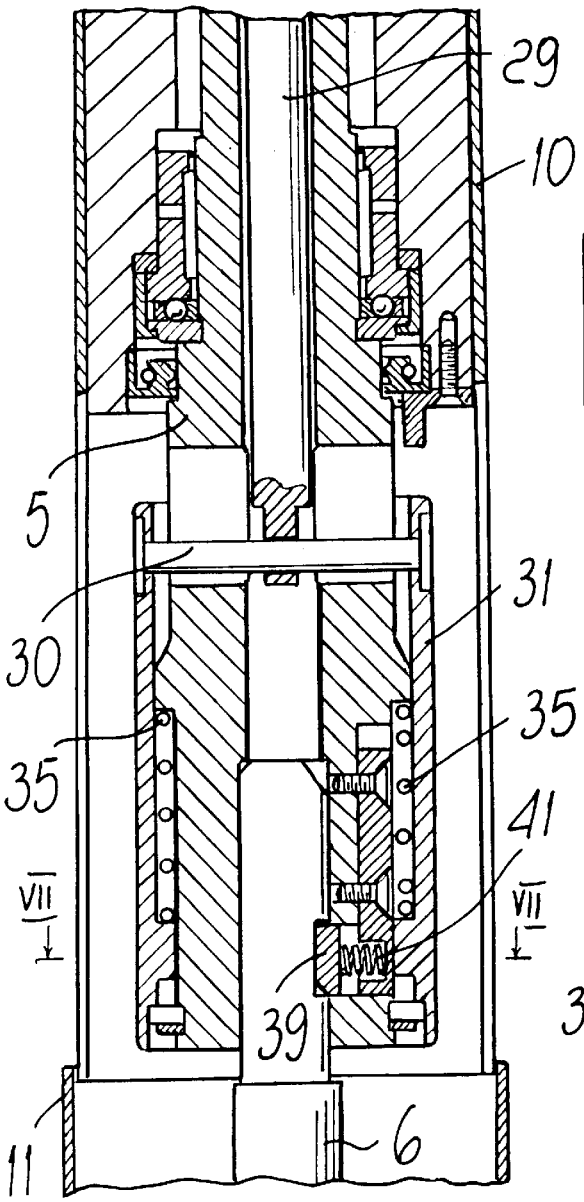
FIG. 5 is a partially sectional side view of the drill according to the present invention.
Figure 6:
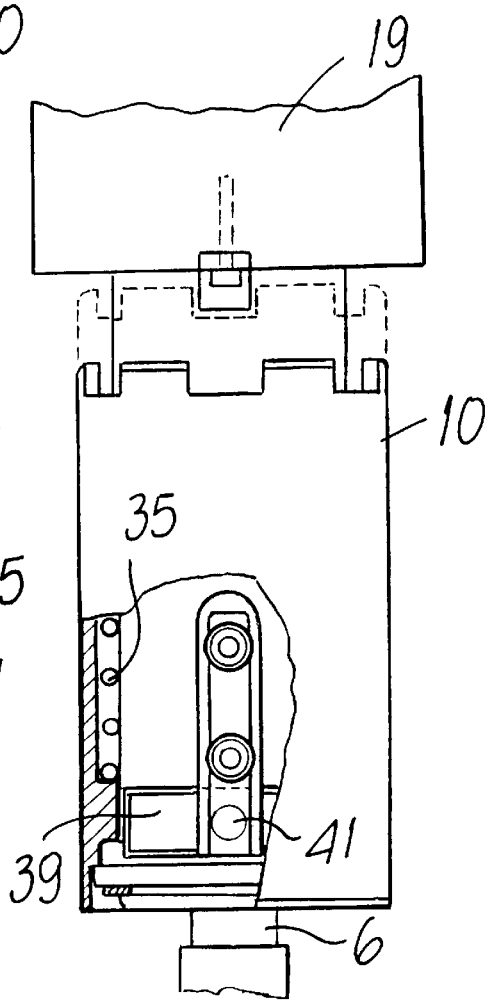
FIG. 6 is a partial cutout front view of the drill according to the present invention.
Figure 7:
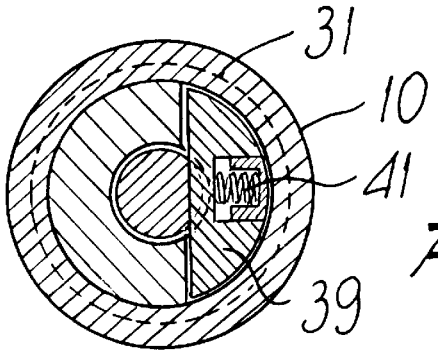
FIG. 7 is a sectional view, taken along the plane VII—VII of FIG. 5.
Figure 8:
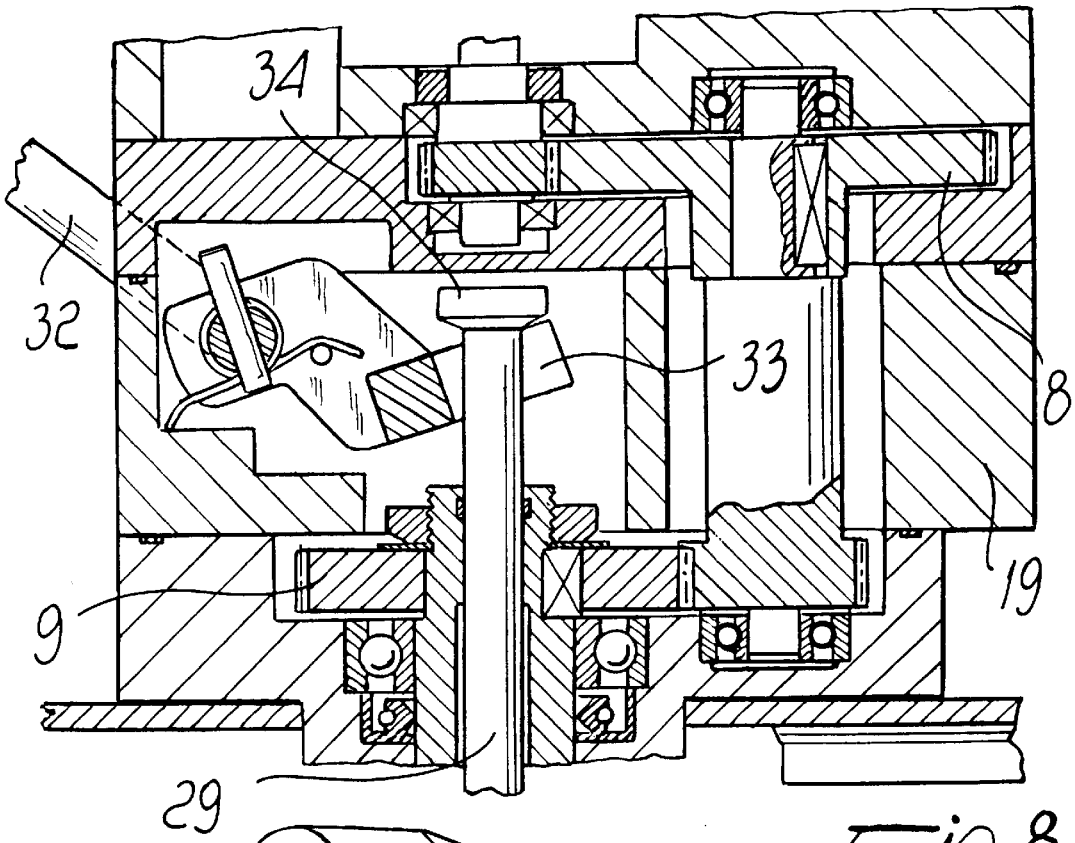
FIG. 8 is a sectional view of a detail of the drill according to the present invention.
Figure 9:
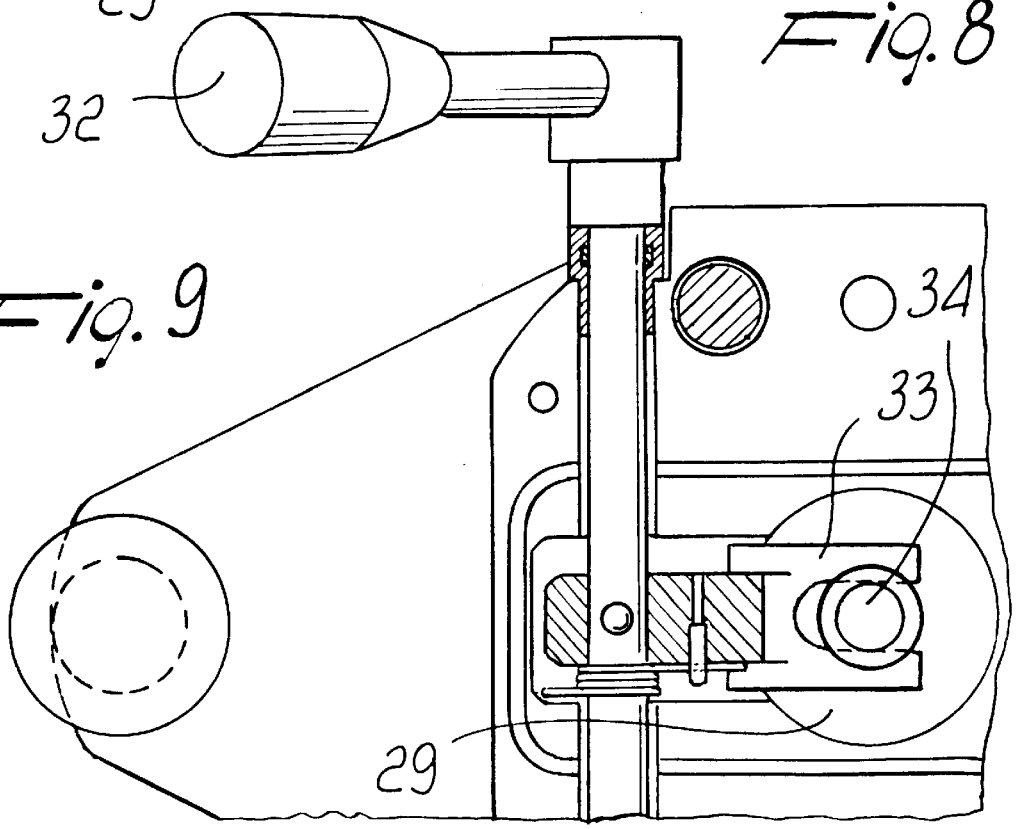
FIG. 9 is a partial sectional view of FIG. 8, illustrating in detail the quick release lever of the bit.

With reference to the above figures, the drill according to the invention, generally designated by the reference numeral 1, comprises a frame 2 which is suitable to constitute a support for a motor assembly 3 and constitutes at the same time a handle for a user.

The portion of the frame 2 constituting the handle of the drill is provided with controls 38 for controlling the motor 3.

The motor assembly 3 generally comprises an internal-combustion engine which is started by pulling a rope which ends with a handle 4.

The frame 2 is connected, at its lower end, which lies opposite to the motor 3, to protective means which are conveniently constituted for example by a protective enclosure which completely surrounds both a chuck 5 and a helical bit 6 connected thereto.

The bit 6 is preferably of the type provided with a front self-tapping element 40.

The chuck 5 is driven by the motor 3 by means of the driving shaft 7 and appropriate gears 8 and 9 which are suitable to transmit the rotation of the driving shaft 7 to the chuck 5.

The protective enclosure consists of a fixed portion 10 and a movable portion 11. The movable portion 11 is suitable to be accommodated in the hole provided in a plate 12 to which a rail 13 is connected, in order to then form a hole in the crosstie 14 so as to couple the plate 12 to the crosstie 14.

The movable portion 11 is thus shaped, in its end region, like a truncated cone and then ends with a cylindrical section suitable to engage the circular cavity provided in the plate 12.

Sliding means, suitable to allow the sliding of the movable portion 11 of the protective enclosure with respect to the fixed portion 10, are provided by two lateral guiding posts 15 and 16 on which elastic resilient means, advantageously constituted for example by two springs 17 and 18, are fitted.

The lateral guiding posts 15 and 16 are parallel to the axis of the chuck 5 and are fixed, in an upward region, respectively at lateral regions of a central portion 19 of the frame 2, which encloses the gears 8 and 9 for transmitting motion to the chuck 5 from the driving shaft 7.

Moreover, the lateral posts 15 and 16 can slide in a downward region in guiding bushes, respectively 20 and 21, which are in turn fixed to the end of diametrically opposite lateral arms 22 and 23.

The bushes 20 and 21 are able to slide along the posts 15 and 16 respectively and contain the springs 17 and 18.

Two threaded knobs 24 and 25 act as lower stroke limiters for the bushes 20 and 21 in their sliding along he posts 15 and 16.

The movable portion 11 of the protective enclosure is provided, in a downward region, at the end part of the bit 6, with suitable slots 26 to allow to empty out the wood chips formed by drilling a wood crosstie 14.

An annular clamp 27 is provided on the fixed portion 10 of the protective enclosure and can slide on the fixed portion; said clamp allows to preset the drilling depth by a graduated scale provided on the outer surface of the fixed portion 10.

The annular clamp 27 is locked by virtue of eccentric means which are controlled by a locking/release lever 28.

Moreover, the drill according to the present invention is provided with means for the quick release of the drilling bit 6.

Said means conveniently comprise a rod 29 which is arranged coaxially to the chuck 5, inside the fixed portion 10 of the protective enclosure, and is coupled to a bar 30 which is arranged transversely to a bush 31 and is rigidly coupled thereto.

A lever 32 is suitable to engage the rod 29 in order to lift or lower it so as to allow quick release of the bit 6.

In detail, the lever 32 engages with a fork-like end 33 the rod 29, which has an enlarged head 34 arranged at its upper end.

The engagement of the lever 32 with the rod 29 and its subsequent lifting cause the bush 31 to also move upward in contrast with the force of a spring 35 which abuts between a raised portion of the bush 31 and a raised portion of the chuck 5 that retains the bit 6.

A key 39 engages the shank of the bit 6 (in a seat formed in the shank of the bit) and is forced into engagement by a spring 41.

With reference to the above figures, operation of the drill according to the present invention is as follows.

The user manually positions the drill 1 so that the movable portion 11 of the protective enclosure is at a hole formed in the plate 12 on which the rail 13 is connected, so as to center the helical bit 6 in the hole in order to drill the underlying crosstie 14 and then allow mutual coupling of the crosstie 14 and of the plate 12.

The actuation of the motor 3 and therefore of the chuck 5 allows the bit 6 that is connected thereto to penetrate the wood of the crosstie 14. The drilling action advance occurs automatically thanks to the self-tapping tip 40 of the bit 6. The user determines beforehand the chosen depth of the drilling action by adjusting the annular clamp 27 by means of the lever 28.

The movable portion 11 of the protective enclosure of the bit 6 thus abuts against the edge of the hole that is formed in the plate 12 and wherein the bit 6 passes.

Continuing the drilling operation causes the constant protrusion of the bit 6 from the protective enclosure and the simultaneous rise of the movable portion 10 of the enclosure, which slides upward by means of the bushes 20 and 21, which can move along the posts 15 and 16.

The upward sliding of the bushes 20 and 21 compresses the respective springs 17 and 18, which thus store elastic energy.

In practice, the movable portion 11 slides with respect to the fixed portion 10 until it partially overlaps it.

When the bit 6 has drilled through the material of the crosstie 14 and thus there is no material to be penetrated at the tip 40 of the bit, the resilient springs 17 and 18 can release the elastic energy stored earlier by means of their compression and thus push upward the entire drill 1, allowing disengagement of the bit 6 from the hole formed in the crosstie 14.

Accordingly, the protective enclosure arranged around the bit 6 of the drill performs the following functions:

- protection for the operator's safety;
- centering element for drilling holes in the crossties 14 at the specifically provided holes formed beforehand on the supporting plates 12 of the rails 13;
- resilient element for the system for adjusting the advancement and rapid return of the drill after drilling.

The drilling depth is determined in practice by the distance that forms between the lower edge of the annular clamp 27 and the upper edge of the movable portion 11 of the protective enclosure.

In this manner, the presence on the bit 6 of a front self-tapping element capable of ensuring that said bit is forced to penetrate the material quickly and without any pressure on the part of the user is utilized fully, since the drill according to the invention allows to adequately control its penetration.

Moreover, the slots 26 allow to dispose of chips formed by the drilling operation.

Another characteristic offered by the drill according to the present invention is the fact that it is possible to quickly release the bit 6 from the drill 1, so as to abandon the work area as quickly as possible if a train is arriving and the bit is stuck in the crosstie during an intermediate step of the drilling operation.

In particular, in order to perform the release operation it is sufficient for the operator to operate the lever 32, pulling up the rod 29 which is rigidly coupled to the bush 31 by means of the bar 30.

The lifting of the bush 31, in contrast with the force of the spring 35, allows to disengage the shank of the bit from the key 39.

By thus keeping the rod 29 pulled (or the lever 32 pressed) and turning the drill 1 slightly, initially the key 39 engages the inner surface of the bush 31, thus rigidly coupling the chuck 5 to the drill body.

Then the bit 6 is released from the chuck by virtue of the automatic upward thrust produced by the quick-return system of the drill.

In this manner it is possible to quickly and easily remove the bit 6 of the drill.

In practice, it has been observed that the drill according to the invention fully achieves the intended aim and objects, since it allows to obtain a drill for drilling wood crossties in the railroad sector which is easy to transport and use, can use currently commercially available bits, allows to work in safe conditions even as regards the possible evacuation of the work area, and finally allows a controlled drilling action at all times.

Moreover, the characteristic of being able to quickly extract the drilling bit from the freshly formed hole and the characteristic of quickly extracting the bit from the chuck of the drill make said drill highly versatile.

The drill thus conceived is susceptible of numerous modifications and variations, all of which are within the scope of the inventive concept; all the details may also be replaced with other technically equivalent elements.

In practice, the materials employed, so long as they are compatible with the specific use, as well as the dimensions, may be any according to requirements and to the state of the art.

What is claimed is:

1. A drill for drilling crossties, particularly for use in the railroad sector, comprising:

a protective enclosure which is formed by a movable portion and by a fixed portion and is suitable to completely cover a chuck of a drill and a drilling bit coupled to said chuck;

sliding means which allow the sliding of said movable portion with respect to said fixed portion when said movable portion is placed at an area to be drilled and at the beginning of the drilling operation; and resilient means which are adapted to bias the sliding of said movable portion with respect to said fixed portion, said resilient means being suitable to be loaded by the penetration of said drilling bit and, at the end of said drilling operation, to be released for the quick disengagement of the bit from a hole formed during the drilling operation;

said sliding means comprising two lateral guiding posts on which said resilient means are fitted, said moving part of the protective enclosure being provided with two diametrically opposite arms on which guiding bushes are fixed which allow the sliding said moving part on said lateral guiding posts.

2. A drill according to claim 1, wherein said sliding means comprise a spring for each post, said springs being accommodated in said bushes.

3. A drill according to claim 1, further comprising means for adjusting the drilling depth which can be positioned adjustably around said fixed portion.

4. A drill according to claim 3, wherein said means for adjusting the drilling depth comprise an annular clamp whose position can be adjusted around said fixed portion of the protective enclosure.

5. A drill according to claim 1, wherein said lateral posts are parallel to the axis of said chuck.

6. A drill according to claim 1, further comprising means for the quick release of said drilling bit.

7. A drill according to claim 6, wherein said means for the quick release of said drilling bit comprise a rod which is suitable to engage a bar for lifting or lowering a bush which is rigidly coupled to said bar and is arranged around said chuck, at the shank of said drilling bit.

8. A drill according to claim 7, further comprising a lever which is suitable to engage, with a fork-like end, the upper end of said rod.

9. A drill according to claim 8, further comprising a spring which is suitable to bias the upward movement of said bush.

10. A drill according to claim 9, further comprising a key which is suitable to engage in a specifically provided seat formed in the shank of said drilling bit, said key being kept engaged with said bit by means of said bush and a spring.

11. A drill according to claim 1, wherein said movable portion has at least one slot for discharging chips formed during drilling.

12. A drill according to claim 1, wherein said movable portion has a lower end which is shaped like a truncated cone and ends with a cylindrical region whose diameter is suitable to engage a hole in which said drilling bit is meant to be placed for the drilling operation.

13. A drill according to claim 1, wherein said lateral guiding posts have stroke limiters in order to limit the stroke of the bushes along the respective posts.

14. A drill according to claim 1, wherein said drilling bit is provided, at the front, with a self-tapping element.

15. A drill for drilling crossties, particularly for use in the railroad sector, comprising:

a protective enclosure which is formed by a movable portion and by a fixed portion and is suitable to completely cover a chuck of a drill and a drilling bit coupled to said chuck;

sliding means which allow the sliding of said movable portion with respect to said fixed portion when said movable portion is placed at an area to be drilled and at the beginning of the drilling operation;

resilient means which are adapted to bias the sliding of said movable portion with respect to said fixed portion, said resilient means being suitable to be loaded by the penetration of said drilling bit and, at the end of said drilling operation, to be released for the quick disengagement of the bit from a hole formed during the drilling operation; and means for the quick release of said drilling bit comprising a rod which is suitable to engage a bar for lifting or lowering a bush which is rigidly coupled to said bar and is arranged around said chuck, at the shank of said drilling bit.

16. A drill according to claim 15, further comprising:

a lever which is suitable to engage, with a fork-like end, the upper end of said rod;

a spring which is suitable to bias the upward movement of said bush; and a key which is suitable to engage in a specifically provided seat formed in the shank of said drilling bit, said key being kept engaged with said bit by means of said bush and a spring.

17. A drill according to claim 15 further comprising means for adjusting the drilling depth which can be positioned adjustably around said fixed portion and which comprise an annular clamp whose position can be adjusted around said fixed portion of the protective enclosure.

18. A drill according to claim 15, wherein said movable portion has at least one slot for discharging chips formed during drilling.

19. A drill according to claim 15, wherein said movable portion has a lower end which is shaped like a truncated cone and ends with a cylindrical region whose diameter is suitable to engage a hole in which said drilling bit is meant to be placed for the drilling operation.

20. A drill according to claim 15, wherein said drilling bit is provided, at the front, with a self-tapping element.

* * * * *